United States Patent [19]

Ausnit

[11] Patent Number: 4,792,240

[45] Date of Patent: Dec. 20, 1988

[54] EXTRUDED ZIPPER STRIPS FOR BAGS

[75] Inventor: Steven Ausnit, New York, N.Y.

[73] Assignee: Minigrip, Inc., Orangeburg, N.Y.

[21] Appl. No.: 106,920

[22] Filed: Oct. 6, 1987

Related U.S. Application Data

[63] Continuation of Ser. No. 812,467, Dec. 23, 1983, abandoned.

[51] Int. Cl.[4] ..... B65D 33/24

[52] U.S. Cl. ..... 383/63; 24/587

[58] Field of Search ..... 383/63–65; 24/587; 156/66; 264/146

[56] References Cited

U.S. PATENT DOCUMENTS

| | | | |
|---|---|---|---|
| 3,338,285 | 8/1967 | Jaster | 383/65 |
| 3,410,327 | 11/1968 | Ausnit | 383/65 |
| 3,416,585 | 12/1968 | Staller | 383/65 |
| 3,425,469 | 2/1969 | Ausnit | 383/65 |
| 3,945,403 | 3/1976 | Noguchi | 138/118 |
| 4,046,408 | 9/1977 | Ausnit | 383/63 |
| 4,285,105 | 8/1981 | Kirkpatrick | 383/63 |
| 4,332,344 | 6/1982 | Strodthoff | 229/62 |
| 4,528,224 | 7/1985 | Ausnit | 383/63 |
| 4,578,813 | 3/1986 | Ausnit | 383/65 |
| 4,610,120 | 9/1986 | Canavesi et al. | 24/587 |
| 4,617,683 | 10/1986 | Christoff | 383/65 |

*Primary Examiner*—Stephen P. Garbe

[57] ABSTRACT

A bag has a reclosable zipper between wall panels and extending between side edges at the top end of the bag, the zipper comprising a continuous length of extruded profile plastic strip folded upon itself for zipper closing interengagement of its profile parts, the profile strip portions being spot welded together at the fold in the strip which may be at one of the side edges of the bag, such as a fold in the material which provides the walls of the bags. The strip may be notched out to facilitate folding. By differential mass, or differential spacing, or tilted biasing of profile parts of the zipper strip, and provision of a lateral flange of substantial width on the strip not only is interlocking of the profile parts facilitated, but an expedient is provided for restraining opening of the zipper by internal bag pressures, while permitting relatively easy opening of the bag from the outside, i.e. the top or mouth end of the bag. Visual determination of orientation of one of a plurality of profile parts of the folded zipper is provided for.

22 Claims, 3 Drawing Sheets

EXTRUDED ZIPPER STRIPS FOR BAGS

This is a continuation, of application Ser. No. 812,467, filed Dec. 23, 1985, now abandoned.

BACKGROUND OF THE INVENTION

This invention relates to the art of bags equipped with reclosable extruded plastic zippers.

As heretofore constructed, extruded zipper equipped bags have generally been provided with separate zipper strips having complementary profiles which are separably enterengagable. This has required producing and handling two separate zipper strips in the bag making process where the strips are separably formed and attached to the bag body sheet or web material. On the other hand, where the profiles are integrally extruded with the film, it has been required to extrude separate complementary profile portions of the zipper on separate panels or panel portions of a bag making film.

In a recent development as covered in the copending application of Christoff and Ausnit, Ser. No. 574,878, filed Jan. 30, 1984, now U.S. Pat. No. 4,617,683 and assigned to the same assignee as the present application, it has been proposed to provide zippers formed from extruded profiled continuous strips folded upon themselves so that the profiles on the folded strip portions interlock to provide reclosable zippers for the bags. In that application it has also been proposed to notch out the zipper profiles at the fold in the strip to facilitate folding of the zipper strip portions upon themselves. However, there has been some problem at the zipper fold in that memory factor of the plastic material tends to spread the fold which may cause a leakage problem at that point. Such leakage may be either of contents from within the bag, or intrusion of foreign matter including air into the bag.

SUMMARY OF THE INVENTION

It is therefore an object of the present invention to gain the advantages of the folded zipper concept and cure the open fold problem.

Another object of the invention is to provide a folded zipper arrangement having means for restraining opening of the zipper due to pressures generated within the associated bag.

Still another object of the invention is to provide new and improved means in a reclosable zipper structure for identifying correct assembly of the zipper with bag forming material.

In a desirable embodiment, the present invention provides a bag having confronting bag body wall panels, opposite side edges, a bottom end and a top end, and including, a reclosable zipper sandwiched between the wall panels and extending between the side edges adjacent to said top end. The zipper comprises a continuous length of extruded profiled plastic strip having a plurality of spaced parallel profile parts and being folded upon itself to provide two parallel strip portions extending from a fold. One of said strip portions is attached to one of the wall panels, and the other strip portion, which is a continuation of said one strip portion, is attached to the other of the wall panels. The profile parts on the strip portions are releasably interlockable for closing the top end of the bag. The fold is located at one of the side edges. The strip portions are spot sealed together a the fold.

BRIEF DESCRIPTION OF THE DRAWINGS

Other objects, features and advantages of the invention will be readily apparent from the following description of representative embodiment thereof, taken in conjunction with the accompanying drawing, although variations and modifications may be effected without departing from the spirit and scope of the novel concepts embodied in the disclosure, and in which.

DETAILED DESCRIPTION

Figure 1:
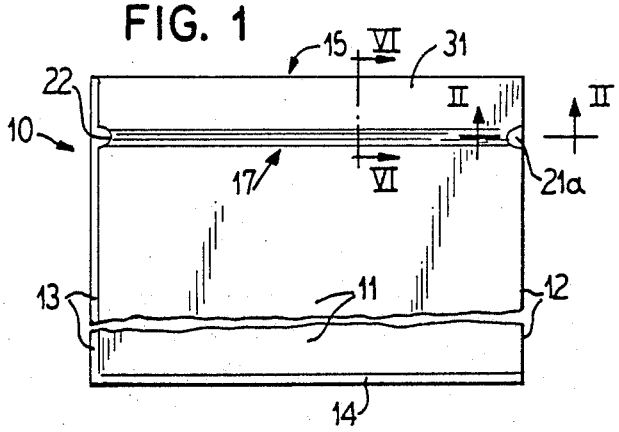
FIG. 1 is a fragmentary elevational view of a bag embodying the present invention.

Referring to FIG. 1, a bag 10 has confronting wall panels 11 which may be made from any suitable sheet material but in a popular form may comprise plastic film such as polyethylene, polypropylene, or the like, either in single thickness material or a laminate where the desirable characteristics of different plastic materials are desired, according to conventional practice.

The panels 11 are connected together along opposite side edges 12 and 13 and along a bottom end 14. At its upper end, the bag 10 has a top opening 15 best visualized in FIG. 6. The side edge 12 may be a fold juncture while the side edge 13 and bottom end 14 may be heat seal seamed closed.

A reclosable zipper 17 is sandwiched between the upper portions of the wall panels 11 and extends lengthwise between the side edges 12 and 13. The zipper 17 comprises a continuous length of extruded profiled plastic strip having a plurality of spaced parallel profile parts, in this instance comprising two parts 18 and 19. The strip is folded upon itself to provide confronting complementary portions 20, which extend from a fold 21. One of the zipper portions 20 is attached to one of the wall panels 11 and the oteer of the portions 20 is attached to the other of the wall portions 11. Desirably the zipper strip fold 21 is located in the folded side 12 of the bag 10. The zipper profile parts 18 and 19 are releasibly interengagable with one another for closing the top opening 15.

Figure 2:
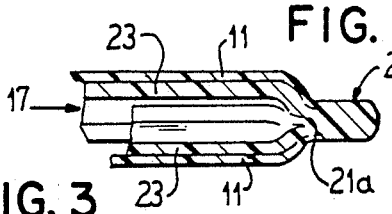
FIG. 2 is an enlarged fragmental sectional detail view taken substantially along the line II—II in FIG. 1.

In order to retain the folded zipper strip portions 20 against springing open at the fold 21, the strip portions 20 are spot sealed together as shown at 21*a*, as visualized in FIGS. 1 and 2. Where the material of the bag wall panels 11 is fusibly compatible with the material of the zipper strips 17, the portions of the wall panels contiguous to the fold spot seal 21*a* may be fusibly sealed to the spot seal 21*a*. In addition, the opposite, originally free ends of the zipper strip portions 20 are desirably spot sealed together as shown at 22. The spot seal 22 may extend inwardly from the heat sealed closure seam 13.

Figure 6:
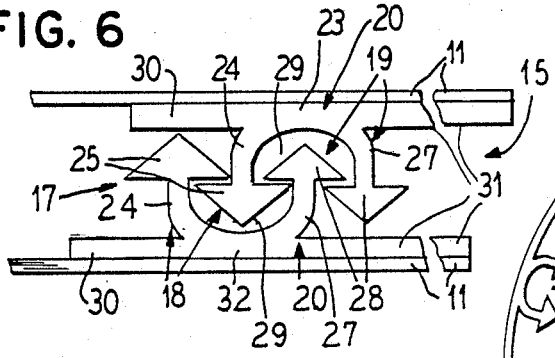
FIG. 6 is an enlarged fragmentary sectional detail view taken substantially along the line VI—VI in FIG. 1.
Figure 7:
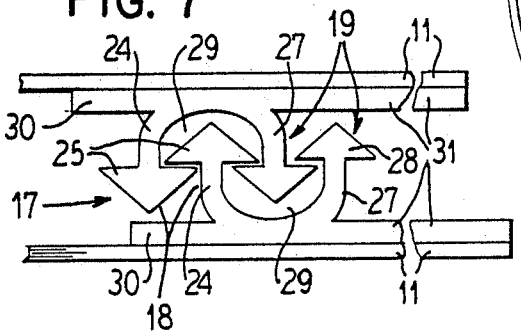
FIG. 7 is a fragmentary sectional detail view similar to FIG. 6, but showing the zipper in an alternative interlocked interengagement.

In an efficient arrangement,tthe zipper strip 17 comprises a flanged base 23 secured either by fusion or adhesively to the bag wall panels 11. From one face of the base 23 the profile parts 18 and 19 project integrally in spaced parallel relation. The profile part 18 has a curved neck 24 topped by an arrow shaped head 25. On the other hand, the profile part 19 has a curved neck 27 and an arrow shaped head 28. In order to facilitate separable interlocking internngagement of the profile parts of the folded zipper strip, the necks 44 and 27 are formed on approximately a common radius and are spaced apart sufficiently to provide a groove 29 receptive of one of the profile part heads 25 or 28 as the case may be. At their confronting sides, the heads 25 and 28 are spaced apart a distance somewhat greater than the thickness of the necks 24 and 27, but less than the overall width of either of the respective heads 25 and 28. Thereby, the respective profile part heads can engage within the groove 29 of the companion folded zipper strip portion as shown in FIGS. 6 and 7. In FIG. 6 the profile part head 28 is engaged in the groove 29 of one of the zipper strip portions 20 and the head 25 is engaged in the groove 29 of the other zipper strip portion 20. As shown in FIG. 7, just the reverse enterengagement of the heads within the grooves prevails. In either event, the zipper is thoroughly closed. Both in the closing manuever and in the separating manuever, the necks 24 and 27 enable resilient flexing of the profile parts for the heads 25 and 28 to pass one another.

In order to provide for thorough resistance to opening of the zipper due to pressures within the bag 10, without inhibiting the opening of the bag by openigg manuever applied at the outside of the bag opening 15, the zipper profile part 18 is constructed stiffer than the part 19 by a somewhat greater mass in at least the profile head 25, and desirably also in the connecting neck 24. This stiffening of the profile rib parts 18 also facilitates interengagement of the zipper portions to assure that the profile part 18 of the folded strp always engages with itself in mutually resistive fashion relative to pressure from the inside of the bag tending to separate the zipper.

Desirably, the zipper base flange 23 extends to both sides of the zipper profile parts, a flange portion 30 which is relatively narrow extending toward the inside of the bag. A flange portion 31 which may be substantially wider extends outwardly toward the top of the bag, and together with the upper portions of the bag side walls 11 provides respective pull flanges which project outwardly from the zipper 17 and facilitate grasping to pull the zipper open when desired. The zipper 17 is easily closed by applying pressure inwardly on the side wall panels in line with the zipper.

By having one of the flange portions 30 or 31, and in this instance the flange portion 31 extending to a substantial width beyond the profile parts 18 and 19, manipulation and attachment of the zipper strip 17 is facilitated. Another advantage of the wider flange portion 31 is that it facilitates folding of the zipper strip 17 upon itself because the web portion 31 allows more readily for the shift in the profiles 18 and 19 when they are folded on each other, and the slipping of the profiles into locking interengagement.

Figure 3:
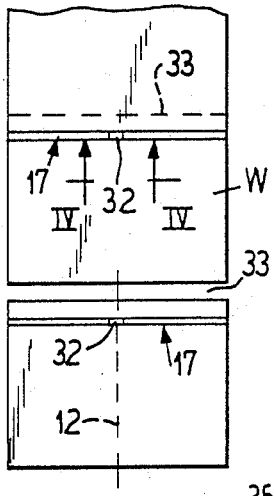
FIG. 3 is a schematic illustration showing how bag making material for the present invention ma be made.

In producing bag material, as indicated in FIG. 3, a continuous ribbon of bag wall web W may be provided. Across the width of the web W and at suitable bag length intervals therealong the zipper strips 17 are attached to the web in any suitable fashion, such as by heat sealing where that is feasible or by means of adhesive, all according to known techniques. Each of the zipper strips 17 may be notched at 32 to facilitate folding of the zipper strip when each bag section is separated from the ribbon W as along a line 33 and then folded along the bag side edge line 12.

Figure 5:
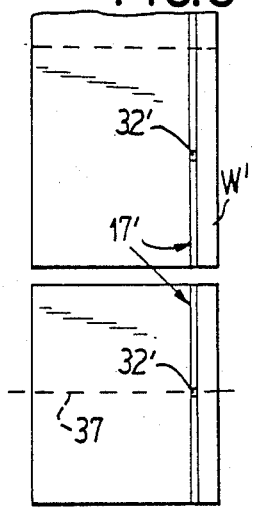
FIG. 5 is a schematic illustration showing a modified way of producing bag making material for the present invention.
Figure 4:
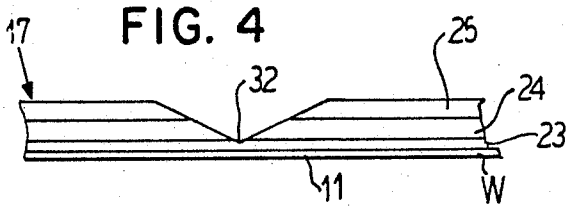
FIG. 4 is an enlarged fragmentary sectional detail view taken substantially along the line IV—IV in FIG. 3.
Figure 8:
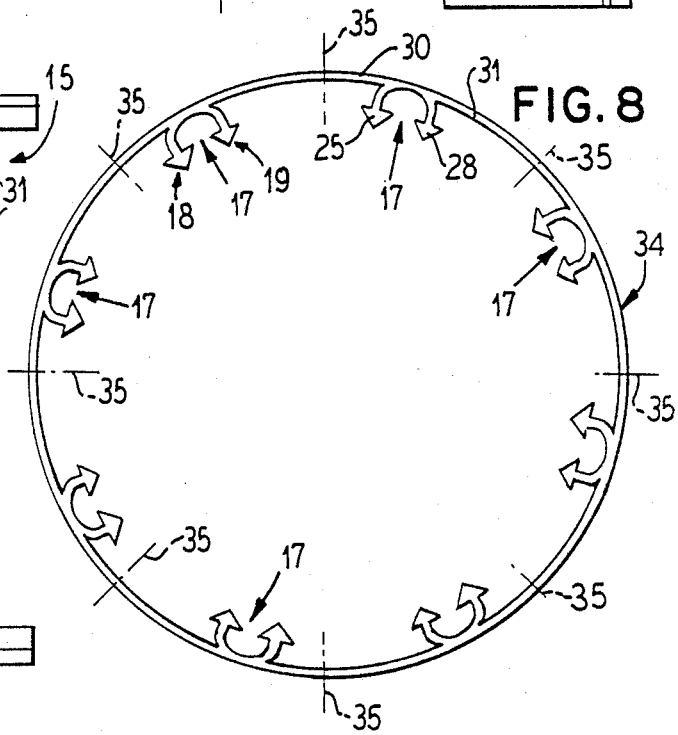
FIG. 8 is a schematic illustration of a manner of extruding zipper strips in a mass production manner.

The zipper strips 17 may be economically produced in a mass production mannerbby extruding a plurality of the strips in a tubular extrusion 34 (FIG. 8). For example, eight of the zipper strips 17 may be produced in the oee extrusion 34 and the extrusion separated along longitudinal lines 35 to divide the same into individual zipper strips 17.

Where it is preferred to produce the web and the zipper profile as a one piece extrusion, the arrangement shown in FIG. 5 may be employed wherein the web ribbon W′ has zipper 17′ integrally extending lengthwise therealong. The overall width of the web w′ will be the same as the desired length of the bags to be made from the web. Then the web is divided into sections as shown which are equivalent rwice the width of the bags to be made therefrom, with each of the bag sections being folded along the line 37 extending through a notch 32′ in the zipper strip to facilitate folding. Of course, if it is preferred to supply the web′ with the zipper 17′ separately fabricated, that may be done, the zipper 17′ being either secured by heat sealing or adhesively, as may be preferred. The end result will be the same as the bag sections derived from the web W in FIG. 3, namely, each bag material section will result in a bag such as the bag 10 in FIG. 1.

Figure 9:
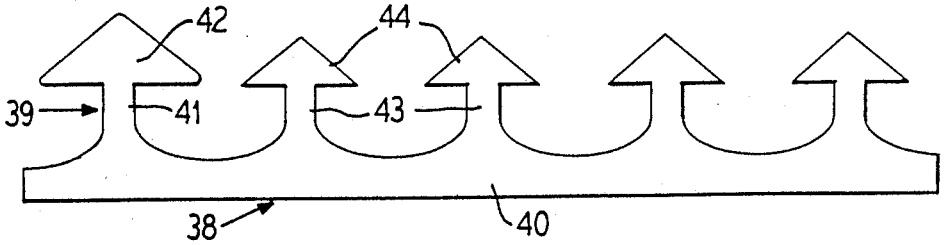
FIG. 9 is an enlarged sectional detail view of a modified form of the zipper strip.

For larger size bags and which may be required to handle large volume contents, a zipper 38 (FIG. 9) may be provided having a plurality of spaced parallel profile parts greater than two. For example, five profile parts 39 are shown carried by a base panel strip 40. In this instance, the profile part 39 along one edge of the base 40 has a neck 41 and an arrow shaped head 42 which is of greater mass than necks 43 and arrow heads 44 of the remaining profile parts. It will be appreciated that the zipper strip 38 is adapted to be used in the same manner as the zipper strip 17, that is the zipper strip 38 is secured to the bag body web, may be notched, and folded upon itself in the same manner. The heavier or greater mass section profile part 41,42 will be located at the inside of the bag and thus resist opening of the zipper due to internal pressures within the bag.

Where the zippers are prefabricated and then assembled with prefabricated film or web, and one side of the zipper in each instance is equipped to provide internal bag pressure resistance as has been described, it is important that the side of the zipper which is so equipped be properly placed when attaching the zipper to the web. Such proper placement, is visually determinable by ready identification or recognition of the resistance equipped side of the zipper, that is the side which is provided by the heavier section profile parts 24,25 (FIGS. 6 and 7) and 41,42 (FIG. 9) previously described herein.

Figure 10:
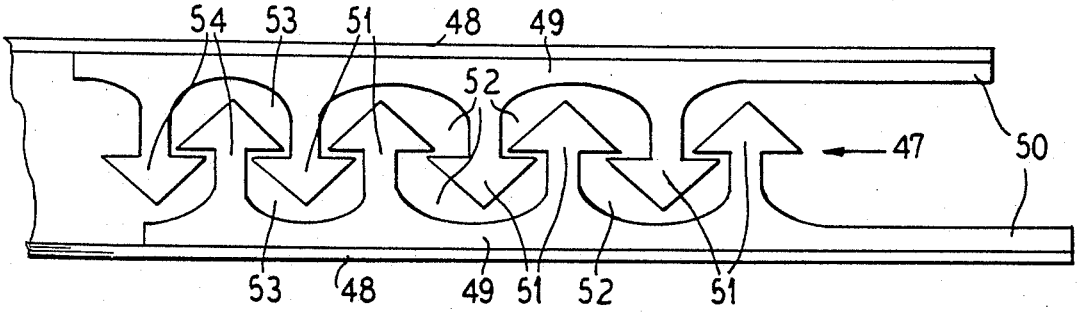
FIG. 10 is a fragmental, enlarged sectional detail view showing another modified form of the zipper strip.

In FIG. 10, there is shown another zipper 47 wherein a single strip is folded upon itself and secured to opposite wall panels 48 of a bag. In this construction, which comprises four generally arrowshaped profiles on a base panel strip 49, there is on the side which is at the mouth end of the bag a side flange 50 which is of substantial width, and not only provides together with the contiguous portions of the bag walls 48 a substantial pull flange, but also facilitates attachment of the components and facilitates folding of the zipper on itself. The three profiles 51 which are closest to the pull flange 50 have groove spaces 52 between them which are all equal but somewhat wider than the width of the arrowhead rib portions of the profiles. On the other hand, a spacing groove 53 between a fourth, innermost profile 54 and the adjacent profile 51 is narrower than the groove spaces 52, but just wide enough to accommodate the rib head of the profile 54. In this manner, the lateral flanges of the rib head of the profile 54 will in each instance oppose to a maximum extent the head flanges of the profiles 51 and 54 alongside the groove space 53 into which the oppssite profile 54 is assembled when closing the zipper 47 by interlocking the profiles. In contrast lesser rib head flange surface opposition exists in the groove spaces 52. As a result, the innermost profile 54 affords substantially greater resistance to separation from separating forces which may develop at the inside of the bag, as compared to separating forces applied to the zipper 47 at the outerside of the bag by manipulation of the pull flanges 50.

Figure 11:
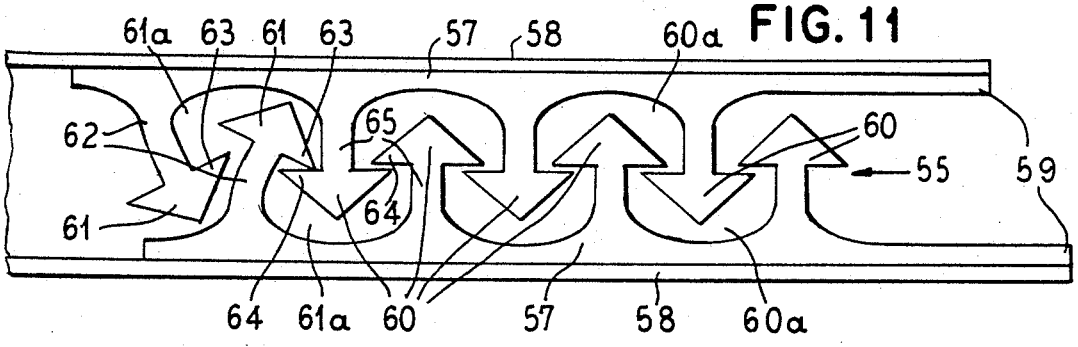
FIG. 11 is a view similar to FIG. 10, but showing still another modified form of the zipper strip.

In another arrangement as shown in FIG. 11, a zipper 55 has opposite zipper strip bases 57 which are secured to opposite wall panels 58 of a bag. Substantially wider flange portions 59 along the outer sides of the zipper strip bases 57 cooperate with the mouth end portions of the bag wall panels 58, and provide substantial pull flanges, as well as the additional advantages of facilitating attachment of the zipper to the wall panels and folding of the zipper strip on itself. In this instance there are four generally arrowshaped zipper profiles on each base strip 57, comprising three identical profiles 60 inwardly from the flange portions 59, and a fourth generally arrowshaped profile 61 at the inner side of each base strip 57. All of the profiles 60 and 61 of the zipper 55 are, in this instance, equally spaced from one anothrr and define grooves 60*a* between the profiles 60 and a respective groove 61*a* between each of the profiles 61 and the adjacent profile 60. Greater resistance to opening due to forces from within the bag is achieved by tilting or biasing the arrowhead of each of the innermost profiles 61 toward the adjacent profile 60, by curving necks 62 of the profiles 61 toward the adjacent profile 60. Through this arrangement, when the profiles are interlocked a side flange 63 on the profile 61 in groove 61*a* interlocks with an adjacent side flange 64 of the nearest profile 60 close to a neck 65 of the profiee 60. Thereby, forces interiorly of the bag tending to separate the zipper are resisted by the interengagement of the side flanges 63 and 64. On the other hand, the normal interengagement of the opposing head side flanges of the profiles 60 permits easier opening of the zipper at the mouth end of the bag as may be effected by manipulation of the pull flanges 59.

Another advantage of the tilted relation of the profile 61 relative to the other profiles is that it provides visual differentiation, or recognition, of profile 61 from especially the adjacent profile 60. Therefore, when assembling the prefabricated zipper with prefabricated film or web, it can be readily determined which side of the zipper is to be placed in the position of internal bag pressure resistance.

Figure 12:
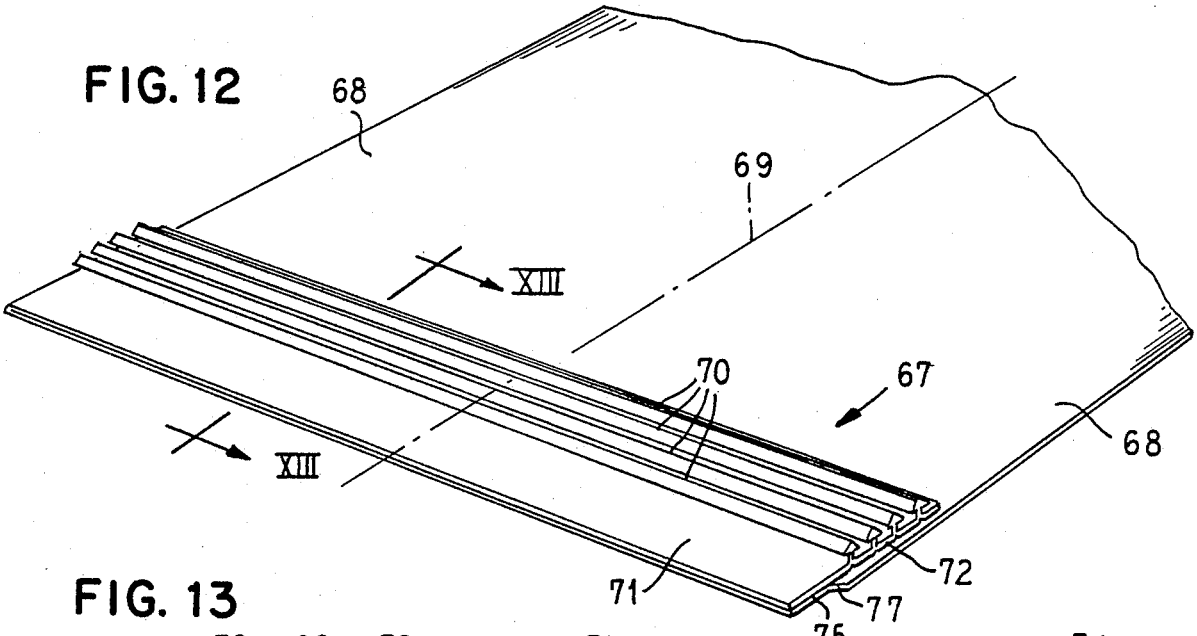
FIG. 12 is a fragmentary perspective view of bag making material showing a still further modification of the zipper strip.
Figure 13:
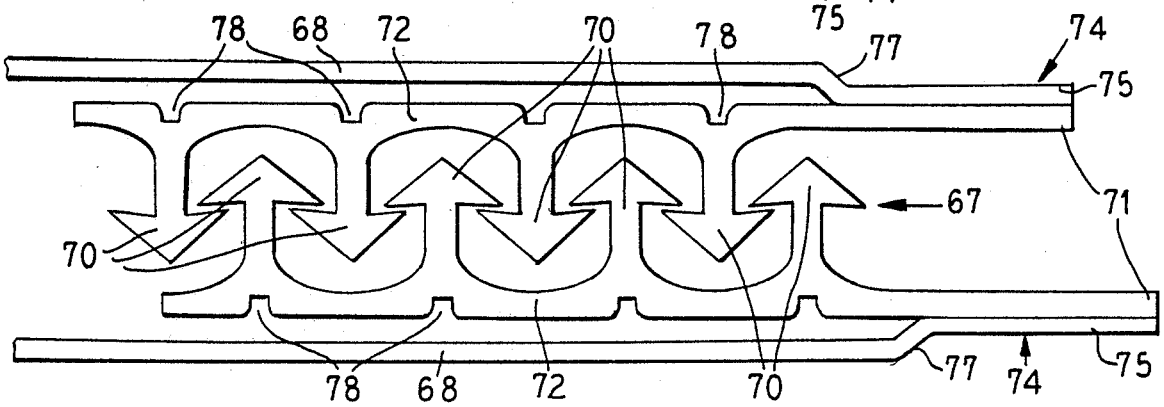
FIG. 13 is an enlarged sectional detail view taken substantially along the line XIII—XIII in FIG. 12.

A zipper strip 67, as depicted in FIGS. 12 and 13, is secured to and across the bag mouth end of bag panels 68 formed from a single sheet of bag material adapted to be folded upon itself along a longitudinal line 69 to bring the panels 68 together in forming a ba.. This fold line 69 intersects the zipper strip 67 so that profiles 70 of the zipper strip will interengage or separably interlock as shown in FIG. 13. At the fold 69, as well as at the opposite interlocked ends of the folded zipper strip 67, the zipper strip may be secured together by spot heat sealing, similarly as described at 21 and 22 in FIGS. 1 and 2.

Generally, like FIGS. 10 and 11, the zipper strip 67 has four arrowshaped profiles 70 which, in this instance, are of the same geometry and equally spaced from one another and are located inwardly from a flange portion 71 of substantial width of base panel 72.

To render the folded zipper 67 capable of resisting opening from the inside of the bag to a substantially greater extent relative to opening from the outer or mouth end of the bag, at which the flange portion 71 serves as part of pull flange structure 74 of the bag, only the flange portion 71 is attached to pull flange end portions 75 of the bag wall panels 68. Thereby, the wall panels 68 are flexibly divertible along hinges 77 relative to the zipper 67. It will be observed that the hinges 77 are spaced from the outermost of the profiles 70. As a result, the bag walls 68 may balloon without placing any significant opening force on the zipper 67. On the other hand, the zipper 67 can be easily opened by manipulating the pull flanges 74.

For greater resilient flexibility, the base 72 may be provided with indented grooves 78 extending longitudinally along the base 72 in alignment with the respective neck portions of the arrowshaped profiles 70.

Figure 14:
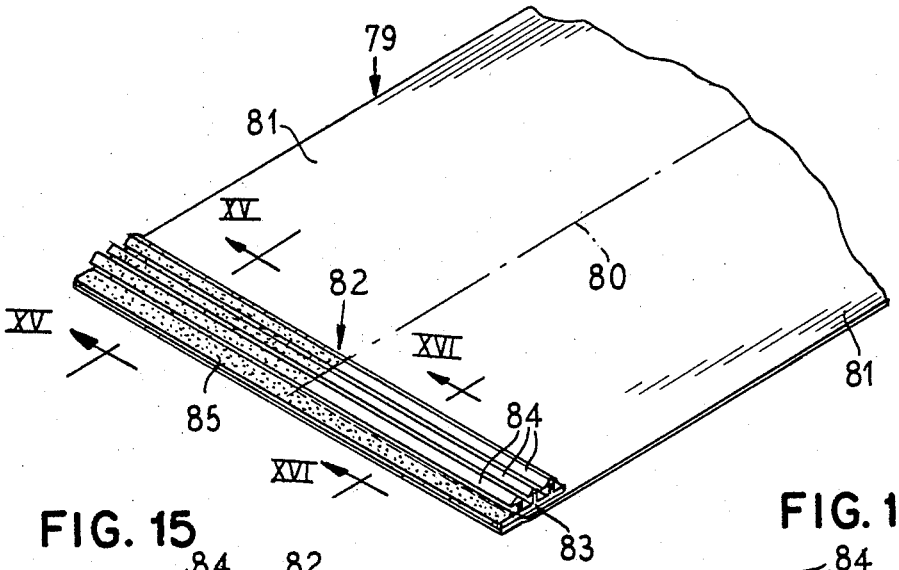
FIG. 14 is a fragmentary perspective view of bag making material, similar to FIG. 12, but showing a modification thereof.
Figure 15:
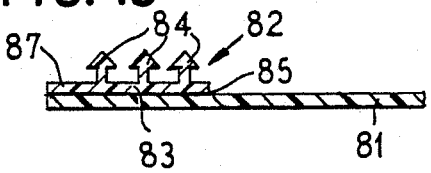
FIG. 15 is an enlarged sectional detail view taken substantially along the line XV—XV in FIG. 4.

As shown in FIG. 14 bag making material, similar to that shown in FIG. 12, may comprise bag wall sheet material 79 of any preferred type suitable for the intended purpose and adapted to be folded along a longitudinal line 80 to provide bag wall panels 81 adapted to be folded upon themselves and sealed along the joined longitudinal edges and then severed into bag length sections from a continuous strip of the material. Along the end of the sheet 79 to form the top reclosable end of a bag, a zipper strip 82 is secured. This zipper strip 82 is of continuous length and extends across the entire width of both of the panels 81, and when the sheet 79 is folded along the line 80, the zipper strip 82 is similarly folded upon itself along that line which extends across the zipper strip. In this instance, the zipper strip 82 comprises a base 83 carrying three generally arrowshaped profiles 84 extending therealong, and which are interlockably separably interengagable when the zipper strip is folded upon itself.

Figure 16:
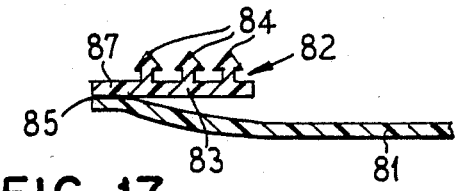
FIG. 16 is an enlarged fragmentary sectional detail view taken substantially along the line XVI—XVI in FIG. 14.

Attachment of the zipper strip 82 to the sheet 79 is in a manner to resist opening of the zipper from the inside of the bag to a substantially greater extent relative to opening from the outer or mouth end of the bag into which the material is to be formed. And for this purpose, the entire face of the base 83 which opposes one of the panels 81 may be secured as by heat sealing or adhesive means 85 (as indicated by stippling in FIG. 14). Such securement includes a pull flange portion 87. On the other of the panels 81, only the pull flange portion 87 of the zipper strip 82 is secured to such panel by the securement means 85, the remainder of the zipper base 83 remaining unattached as shown in FIG. 16. In the finished bag, this affords stress relief avoiding opening of the closed zipper due to internal pressures within the bag.

Figure 17:
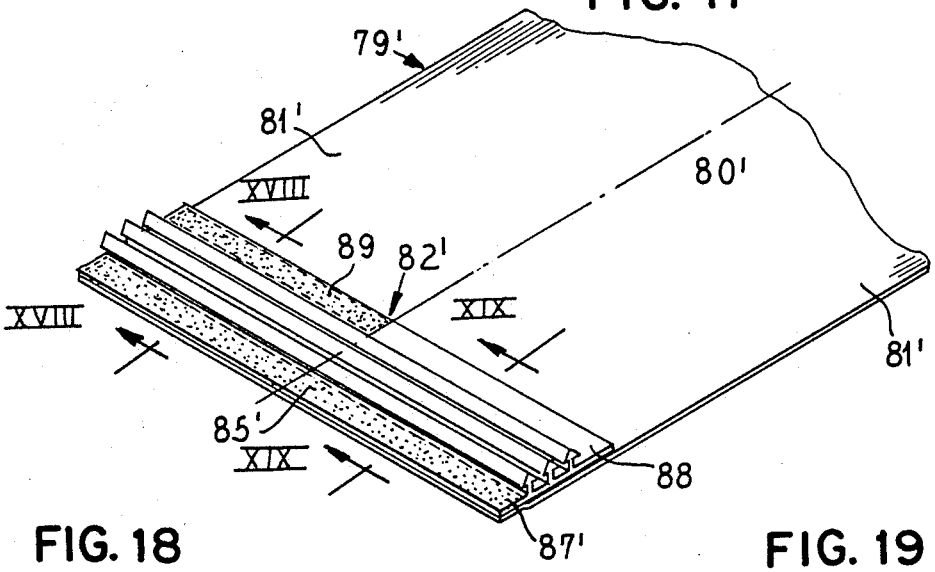
FIG. 17 is a fragmentary perspective view of bag making material, similar to FIG. 14, but showing still another modification.
Figure 18:
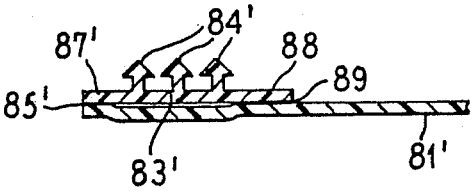
FIG. 18 is an enlarged sectional detail view taken substantially along the line XVIII—XVIII in FIG. 17.
Figure 19:
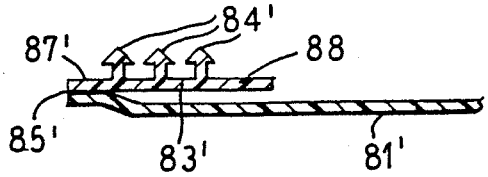
FIG. 19 is an enlarged fragmentary sectional detail view taken substantially along the line XIX—XIX in FIG. 17.

The construction in FIG. 17 is similar to the construction in FIG. 14, and therefore primed reference numerals are applied in FIG. 17 to identify substantially similar parts. As noted, a film or sheet 79' in a continuous ribbon or strip of desired width to be formed into successive bag sections is arranged to be divided longitudinally along a line 80' to provide panels 81' to be folded onto themselves and then secured together at their longitudinal edges. A zipper strip 82' having a base 83' and generally arrowshaped profiles 84' extends across the sheet 79' at the place which will provide the top or reclosable end of a bag when the material is folded upon itself,including the strip 82' wherein the profiles 84' are releasably interlockable. Along what will be the top of the bag, the strip 82' has a pull flnnge extension 87' which is secured by means 85' to the bag wall sections 81'. In this instance, the zipper strip 82' has an inward lateral flange extension 88 projecting in the opposite direction from the flange 87'. The flange 88 may be secured by means 89 such as heat sealing or adhesive to one of the panels 81' but, as shown in FIG. 17 and 18, remain unsecured to the other of the panels 81' as shown in FIG. 17 and 19. This serves to relieve the closed zipper from internal pressures within the ultimate bag which might tend to open the zipper from the inside. It will be observed that except for the securing means 85' and 89, the base portion of the zipper strip 82', including the flange 88, remains unattached to the sheet 79'.

It will be understood that variations and modifications may be effected without departing from the spirit and scope of the novel concepts of the present invention.

I claim as my invention:

1. A bag having confronting bag body wall panels, opposite side edges, a bottom end and a top end, and including:

a reclosable zipper sandwiched between said wall panels and extending between side edges adjacent to said top end;

said zipper comprising a continuous length of extruded profiled plastic strip having a plurality of spaced parallel profile parts and being folded upon itself to provide two parallel strip portions extending from a fold;

one of said strip portions being attached to one of said wall panels and the other strip portion being attached to the other of said wall panels;

the profile parts on said one strip portion being releasably interlockable with the profile parts on said other strip portion for closing said top end of the bag;

said fold being located at one of said side edges; and a spot seal securing said strip portions together at said fold.

2. A bag according to claim 1, wherein said profile parts have arrow shaped heads connected by resiliently flexible necks to said zipper strips, adjacent sides of said heads defining with the associated necks a groove receptive of a head of the companion zipper strip portion in interlocked relation with said adjacent sides of the heads.

3. A bag according to claim 2, wherein said zipper strip has a base portion with a flange extension of substantial width along one side of the strip.

4. A bag according to claim 2, wherein said profile parts along the side of the folded zipper strip portions at the inside of the bag have means for resisting opening of the zipper due to forces within the bag, but permitting relatively easy opening by forces applied for opening the zipper from the top end of the bag.

5. A bag according to claim 4, wherein said means for resisting opening comprises a greater mass and stiffness of the profile part at the inner side of the bag.

6. A bag according to claim 4, wherein said profile parts comprise at least three spaced profiles, and wherein the profile at the inner side of the bag is spaced more closely relative to the next adjacent profile than the remaining profiles are spaced apart.

7. A bag according to claim 4, wherein said profile are generally arrowshaped, and said means for resisting opening comprising the arrowshaped profile at the inner side of the bag tilted toward the adjacent arrowshaped profile.

8. A bag according to claim 1, including means for resisting opening of the zipper from the inside of the bag and which comprises means attaching said strip portions to said wall panels along the side of the zipper adjacent to said top end, and at least major areas of the remainder of the strip portions being free from said wall panels.

9. A bag according to claim 1, including means fully attaching said one strip portion to said one of said wall panels, and means attaching the other of said strip portions to the other of said wall panels only along a narrow area of said other strip portion adjacent to said bag top end while the remaining area of said one strip portion remains free from the other of said wall panels.

10. A bag according to claim 1, including means for attaching to said one of the wall panels the opposite sides of said one of said strip portions, the area of said one strip portion between said attached sides of said one strip portion being free from attachment to said one wall panel, and the other of said strip portions being free from the other of said wall panels except along the side of said other strip portion which is adjacent to said bag top end.

11. A bag according to claim 1, wherein said top end of the bag has pull flanges for assisting in opening said zipper, and said strip portions have lateral flanges forming part of the pull flanges.

12. A bag according to claim 1, wherein one of said profile parts has a construction indicating positioning of a particular side of the profile strip relative to said top end.

13. A bag according to claim 12, wherein said one profile part tilts toward the next adjacent part.

14. A bag according to claim 12, wherein said one profile part is of substantially greater mass than a next adjacent profile part.

15. An extruded plastic zipper strip having a plurality of spaced parallel profiles side of the strip being adapted to be adjacent to the mouth end of a bag and the other side of the strip being adapted to be at the inner side of the bag, and comprising:

said profiles being of arrowshape, and the strip being foldable upon itself for separable interengagement of said profiles of the folded portions of the strip;

and the profiles at said other side of the strip being more closely spaced than the profiles at said one side of the strip so that in the folded strip substantially greater force is required to separate the profiles at said other side of the folded strip than required to separate the profiles at said one side of the folded strip.

16. An extruded plastic zipper strip having a plurality of spaced parallel profiles, one side of the strip being adapted to be adjacent to the mouth end of a bag and the other side of the strip being adapted to be at the inner side of the bag, and comprising:

all of said profiles being of generally arrowshape having arrowhead profile portions connected to a base by a respective stem;

said strip being foldable upon itself for separable interengagement of said profiles of the folded portions of the strip;

and the profile at said other side of the strip having its stem biased toward the next adjacent profile so that in the folded strip separation of the profiles by forces from the inside of the bag will be resisted to a greater extent than forces applied for separating the profiles from the outside of the bag.

17. A bag having confronting bag body wall panels, opposite side edges, a bottom end and a top end, and including:

a reclosable zipper sandwiched between said wall panels and extending between said edges adjacent to said top end;

said zipper comprising a continuous length of extruded profiled plastic strip having a plurality of spaced parallel profile parts and being folded upon itself to provide two parallel strip portions extending from a fold;

one of said strip portions being attached to one of said wall panels and the other strip portion being attached to the other of said wall panels;

the profile parts on said one strip portion being releasably interlockable with the profile parts on said other strip portion for closing said top end of the bag;

and one of said profile parts which is common to both of said strip portions being visually differentiated from an adjacent profile part so that as folded together a preferred orientation of the respective portions of said one profile part on said strip portions can be visually determined.

18. A bag according to claim 17, wherein said one profile part is visually differentiated by being tilted toward a profile part adjacent thereto.

19. A bag according to claim 18, wherein said one profile part is at the side of said zipper which faces towards said bottom end of the bag.

20. A bag according to claim 18, wherein said one profile part is of generally arrow shape in cross section and has a curving neck.

21. A bag according to claim 17, wherein said one profile part is of generally arrow shape cross section and has a curving neck which effects a tilted relation of said one profile part toward the nearest adjacent profile part.

22. A bag according to claim 17, wherein said one profile part is of substantially greater mass than an adjacent profile part.

* * * * *